US005101702A

United States Patent [19]

Kuchler

[11] Patent Number: 5,101,702

[45] Date of Patent: Apr. 7, 1992

[54] SLICING MACHINE WITH ALTERNATE-SLICE STACKER

[76] Inventor: Fritz Kuchler, Klatteweg 4, A-9010 Klagenfurt, Austria

[21] Appl. No.: 696,081

[22] Filed: May 7, 1991

[30] Foreign Application Priority Data

May 11, 1990 [AT] Austria ..... 1052/90

[51] Int. Cl.[5] ..... B26D 7/32

[52] U.S. Cl. ..... 83/23; 83/29; 83/94; 83/932; 83/155.1

[58] Field of Search ..... 83/23, 28, 29, 932, 83/94, 96, 42, 707, 155.1

[56] References Cited

U.S. PATENT DOCUMENTS 3,956,518 5/1976 Goldbach ..... 83/29 X 4,793,228 12/1988 Etter et al. ..... 83/23 X

*Primary Examiner*—Frank T. Yost

*Assistant Examiner*—Kenneth E. Peterson

*Attorney, Agent, or Firm*—Herbert Dubno; Andrew Wilford

[57] ABSTRACT

An apparatus for cutting slices from two foodstuffs and for stacking the slices has a blade having an input side and an output side and an input table on the input side adapted to support the two foodstuffs next to each other and displaceable on the input side of the blade past same to cut slices from the foodstuffs so that the slices pass to the output side. A plurality of conveyor elements extending downstream from the output side of the blade displace the slices sequentially as they come from the blade through an upstream position adjacent the blade and into a downstream position. An output table is provided on the output side adjacent the downstream station and a transfer fork having tines engaged between the conveyor elements extends through the downstream station but not to the upstream station. An actuator connected to the transfer fork displaces the fork through the conveyor and lifts a slice from the downstream station and deposits it on the output table without engaging a slice in the upstream station each time a slice arrives in the downstream station. The slice in the upstream station is moved to the downstream station after a slice in the downstream station has been lifted therefrom by the fork and deposited on the output table and then this slice is lifted and deposited by the fork on the slice on the output table.

5 Claims, 2 Drawing Sheets

SLICING MACHINE WITH ALTERNATE-SLICE STACKER

FIELD OF THE INVENTION

The present invention relates to a slicing machine. More particularly this invention concerns such a machine which stacks the slices it makes.

BACKGROUND OF THE INVENTION

A standard slicing machine has an input table that can be reciprocated longitudinally past a normally circular rotating blade to cut slices from a foodstuff, for instance a piece of meat or cheese, sitting on the input table. On the other side of the blade the slices are picked up by a conveyor, typically a fork-, belt-, or chain-type arrangement having a vertical support plane and provided with a multiplicity of sharp points so that the slices can be caught on the conveyor as they issue from the downstream side of the blade. A transfer fork has tines engaged between adjacent elements of the conveyor and can be pivoted to pull the slices off the conveyor and deposit them on an output table which is positioned horizontal underneath the downstream side of the blade. Thus as the input table is moved back and forth, slices are cut from the foodstuff thereon, these slices pass the blade and are picked up the conveyor and the transfer fork deposits them in a stack on the output table.

In a high-volume delicatessen or butcher shop it is standard for the operator to load two individual foodstuffs on the input table to cut two separate slices with each stroke of the table, depositing these slices as two separate stacks on the output table. It is also known for the conveyor to be set up in combination with a movable output table to deposit the slices in a particular pattern. Such machines are described in detail in my earlier U.S. Pat. Nos. 4,185,527, 4,217,650, 4,338,836, 4,379,416, 4,586,409, 4,598,618, 4,763,738, and 4,867,257.

A frequent request in a delicatessen, however, is a sandwich containing more than one sort of sliced meat and/or cheese. Similarly it is common to want to arrange a platter with alternating slices of different meats and cheeses. To honor such a sandwich request the operator typically makes a short stack of slices of the one foodstuff, then switches to the other foodstuff and makes another short stack of it atop the first stack. To make an alternate-slice platter, the pieces must be manually set out. Not only does is this procedure somewhat wasteful of time, but in a sandwich the separate stacks do not produce the taste blend that the person making the order usually wants.

OBJECTS OF THE INVENTION

It is therefore an object of the present invention to provide an improved slicing and stacking machine.

Another object is the provision of such an improved slicing and stacking machine which overcomes the above-given disadvantages, that is which can be loaded with two different foodstuffs and that can produce on its output table a stack with the two foodstuffs in a single stack with the slices alternately being one foodstuff and then the other.

A further object is to provide an improved method of operating such a machine and of slicing and stacking foodstuffs.

SUMMARY OF THE INVENTION

An apparatus for cutting slices from two foodstuffs and for stacking the slices according to the invention has a blade having an input side and an output side and an input table on the input side adapted to support the two foodstuffs next to each other and displaceable on the input side of the blade past same to cut slices from the foodstuffs so that the slices pass to the output side. A plurality of conveyor elements extending downstream from the output side of the blade displace the slices sequentially as they come from the blade through an upstream position adjacent the blade and into a downstream position. An output table is provided on the output side adjacent the downstream station and a transfer fork having tines engaged between the conveyor elements extends through the downstream station but not to the upstream station. An actuator connected to the transfer fork displaces the fork through the conveyor and lifts a slice from the downstream station and deposits it on the output table without engaging a slice in the upstream station each time a slice arrives in the downstream station. The slice in the upstream station is moved to the downstream station after a slice in the downstream station has been lifted therefrom by the fork and deposited on the output table and then this slice is lifted and deposited by the fork on the slice on the output table.

Thus with this arrangement it is possible to stack up two or more different foodstuffs and produce a stack with the various foodstuffs alternating or interleaved with each other. Thus, for instance, making a ham-and-cheese sandwich is as easy as putting the ham and cheese on the input table and cutting off the requisite number of slices. The instant invention is easily carried out by a machine that closely resembles that of the prior art except that the flipper or transfer fork is substantially shorter and the cycle of the transfer fork is twice that of the output conveyor. In other words rather than having the output conveyor, and transfer device both operate through one cycle for each stroke of the input table, instead the output conveyor operates in two steps and the transfer fork operates synchronously with the output conveyor for each single stroke of the input table.

It is also possible according to this invention for the conveyor to be a plurality of endless conveyor elements defining an upright carrying surface and provided with points on which the slices can be engaged. Alternately the tines of the fork can be of a length equal to that of the conveyor belt and the fork can be displaceable between a position with the tines extending through both positions and a position extending only through the downstream position. In another arrangement of this invention there is a second fork having long tines extending through both positions and means is provided for sliding the fork back and forth between a two-stack position with its tines extending through both positions and a one-stack position extending only through the downstream position.

The method of this invention therefore comprises the steps of sequentially cutting slices from each of the foodstuffs and conveying them together until one of them is in a downstream station and the other is in an adjacent upstream station, picking the one slice in the downstream station therefrom and depositing it on an output table, conveying the other slice from the upstream to the downstream station, and picking the other slice in the downstream station therefrom and depositing it on top of the one slice on the output table. Then these steps are iteratively repeated to produce a stack of slices of the two foodstuffs alternating on the output table.

BRIEF DESCRIPTION OF THE DRAWING

The above and other objects, features, and advantages will become more readily apparent from the following, reference being made to the accompanying drawing in which.

DESCRIPTION

Figure 1:
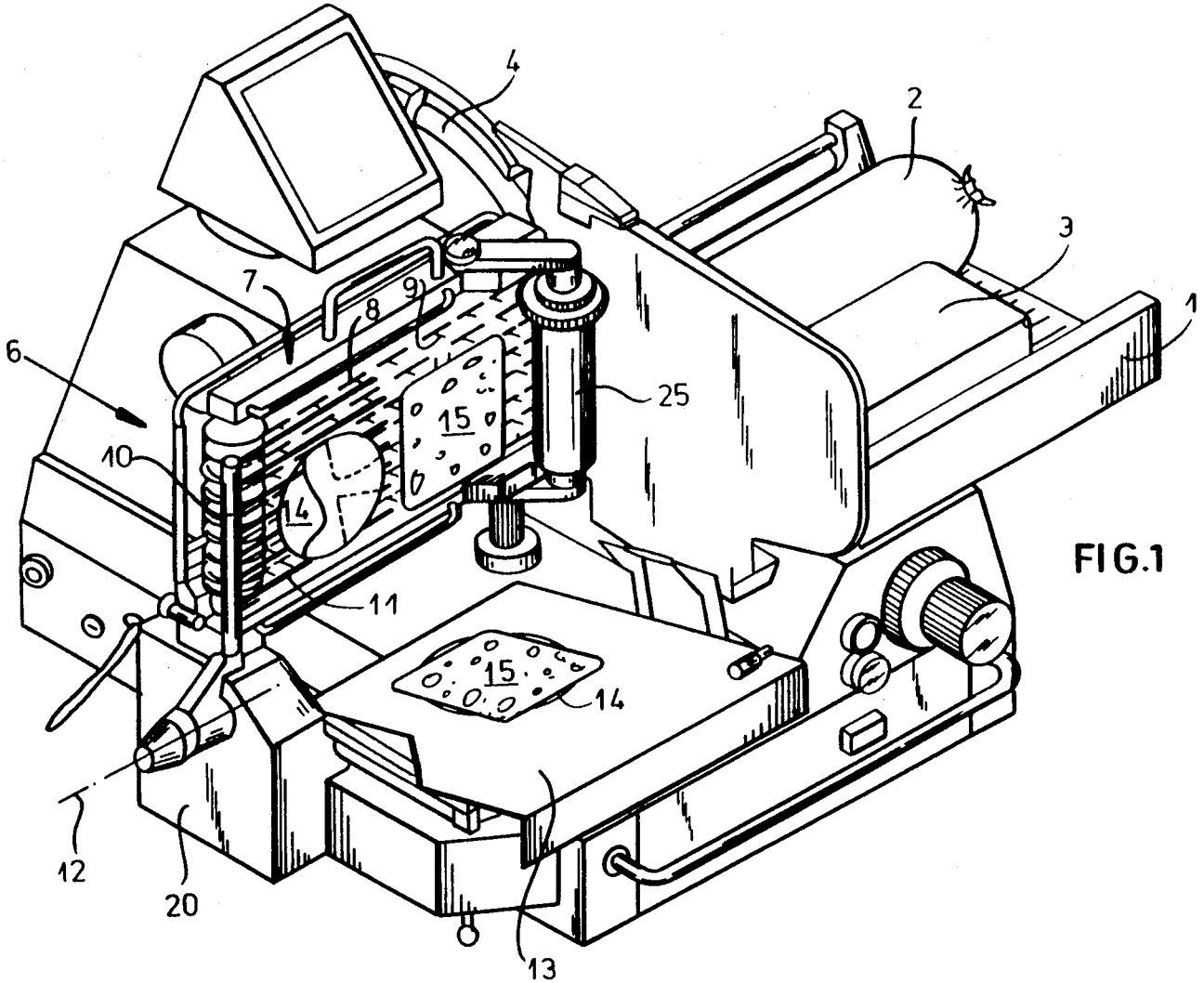
FIG. 1 is an isometric view of the apparatus according to the invention.
Figure 2:
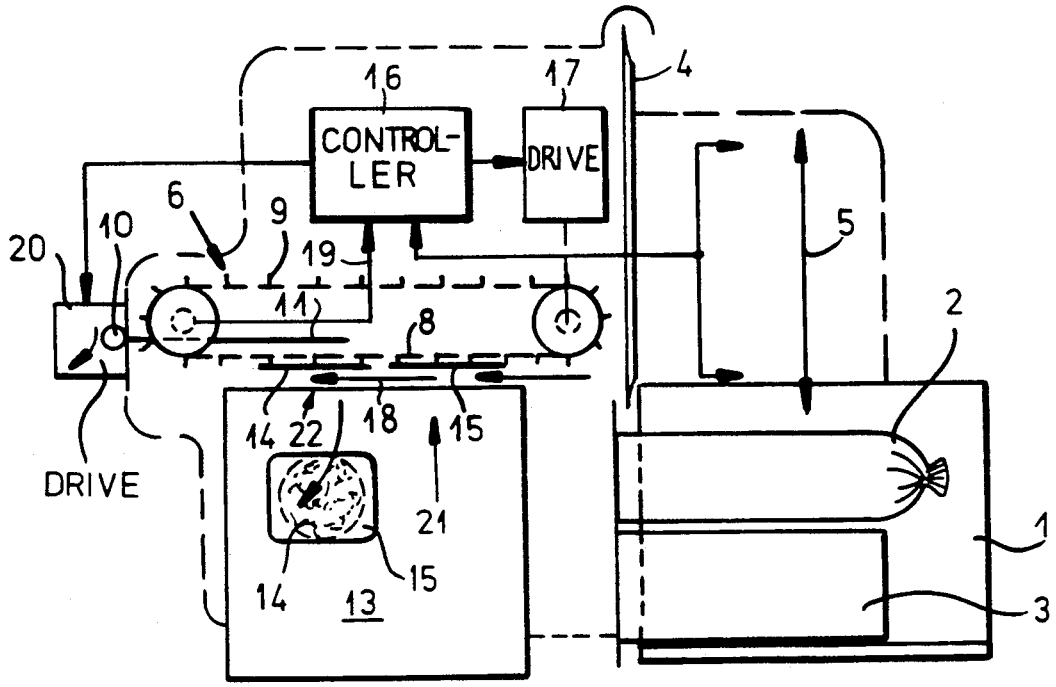
FIG. 2 is a largely schematic top view of the apparatus.

As seen in FIGS. 1 and 2 an input table or carriage 1 carries a basically cylindrical and elongated luncheon meat 2 and a basically parallepipedal and elongated cheese 3 arranged parallel to each other and perpendicular to a circular blade 4 and a displacement direction 5 in which the table 1 can move. On the other side of the blade 4 is an output conveyor 6 comprised of a frame 7 over which are spanned eight endless horizontal chains 8 carrying points 9. Slices 14 and 15 cut from the meat 2 and cheese 3, respectively, are automatically passed from the blade 4 to the conveyor 6 to be moved thereby in a direction 18 perpendicular to the direction 5 through upstream and downstream positions 21 and 22. A roller 25 presses the slices !4 and 15 onto the points 9 so that these slices 14 and 15 hold thereon.

According to this invention a transfer fork 10 has seven tines 11 interleaved with the conveyor chains 8 and extending from a pivot at the downstream end of the conveyor 6 past the downstream station 22 but not to the station 21. The transfer fork 10 is pivotal about an axis 12 parallel to the direction 18 and perpendicular to the direction 5 to pick a slice 14 or 15 out of the station 21 and lay it on an output table 13 that extends horizontally in front of and underneath the conveyor 6.

A controller 16 is connected to the drive 17 for the conveyor 6 and receives input at 19 indicating how far advanced the leading slice 14 or 15 carried by the conveyor 6 has moved. In addition the table 1 is coupled in a manner well known per se to the conveyor 6, for instance by having a common drive-assist motor, so that both operate synchronously at the same speed. The fork 10 is operated in turn by an actuator 20 that is also operated by the controller 16.

With this system the drive 20 is actuated twice for each front-to-back stroke of the table 1 and each side-to-side movement of the conveyor 6. Thus as the two pieces 14 and 15 cut off the foodstuffs 2 and 3 move in the direction 18 along the conveyor 8 and the leading piece (14 as seen in FIG. 1) reaches the downstream station 22, the drive 20 is actuated to strip this piece 14 off the points 9 and lay it on the table 13 and the fork 10 is moved quickly back into place below the vertical carrying plane of this conveyor 6. Then when the next piece 15 comes into the position 22, the fork 10 is operated again to place it atop the previously deposited piece 14 In this manner a stack is formed of alternate slices of luncheon meat and cheese.

Figure 3:
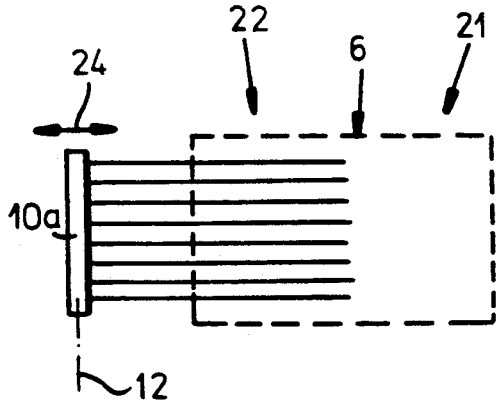
FIGS. 3 and 4 are small scale schematic views illustrating two variations on the system of this invention.
Figure 4:
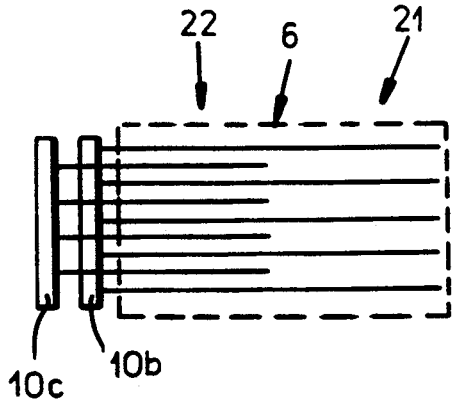

The system could equally be adapted to cut more than two foodstuffs and stack them up in one pile. Similarly it would be possible to replace the short fork 10 with a long fork to form two separate piles in the manner well known in the prior art. As seen in FIG. 3 a long fork 10*a* could be provided which is movable with its pivot axis 12 as shown by arrow 24 so that it reaches either only through the downstream station 22 or through both stations. Similarly as seen in FIG. 4 a long fork 10*b* and a short fork 10*c* could both be provided, with the short one only used when everything was to be put in a single pile on the output table 13.

I claim:

1. An apparatus for cutting slices from two foodstuffs and for stacking the slices, the apparatus comprising:

a blade having an input side and an output side;

an input table on the input side adapted to support the two foodstuffs next to each other and displaceable on the input side of the blade past same to cut slices from the foodstuffs, whereby the slices pass to the output side;

transport means including a plurality of conveyor elements extending downstream from the output side of the blade for displacing the slices sequentially as they come from the blade through an upstream station adjacent the blade and into a downstream station;

an output table on the output side adjacent the downstream station;

a transfer fork having tines engaged between the conveyor elements and extending through the downstream station but not to the upstream station;

actuator means connected to the transfer fork for displacing the fork through the conveyor and lifting a slice from the downstream station and depositing it on the output table without engaging a slice in the upstream station each time a slice arrives in the downstream station; and control means connected to the conveyor and actuator means for displacing the slice in the upstream station to the downstream station after a slice in the downstream station has been lifted therefrom by the fork and deposited on the output table.

2. The slicing and stacking machine defined in claim 1 wherein the conveyor is a plurality of endless conveyor elements defining an upright carrying surface and provided with points on which the slices can be engaged.

3. The slicing and stacking machine defined in claim 1 wherein the tines of the fork are of a length equal to that of the conveyor belt and the fork is displaceable between a position with the tines extending through both stations and a position extending only through the downstream station.

4. The slicing and stacking machine defined in claim 1, further comprising a second fork having long tines extending through both stations.

5. A method of slicing and stacking two different foodstuffs, the method comprising the steps of:

(a) sequentially cutting slices from each of the foodstuffs and conveying them together until one of them is in a downstream station and the other is in an adjacent upstream station;

(b) picking the one slice in the downstream station therefrom and depositing it on an output table;

(c) conveying the other slice from the upstream to the downstream station;

(d) picking the other slice in the downstream station table; and (e) iteratively repeating steps a) through d) sequentially to produce a stack of slices of the two foodstuffs alternating on the output table.

* * * * *